US009869468B2

(12) United States Patent
Tamura et al.

(10) Patent No.: US 9,869,468 B2
(45) Date of Patent: Jan. 16, 2018

(54) BURNER DEVICE FOR HIGH-TEMPERATURE AIR COMBUSTION

(75) Inventors: Masato Tamura, Tokyo (JP); Takahiro Kozaki, Tokyo (JP)

(73) Assignee: IHI CORPORATION (JP)

( * ) Notice: Subject to any disclaimer, the term of this patent is extended or adjusted under 35 U.S.C. 154(b) by 536 days.

(21) Appl. No.: 13/981,848

(22) PCT Filed: Jan. 27, 2012

(86) PCT No.: PCT/JP2012/051774

§ 371 (c)(1),
(2), (4) Date: Jul. 25, 2013

(87) PCT Pub. No.: WO2012/105434

PCT Pub. Date: Aug. 9, 2012

(65) Prior Publication Data

US 2013/0305968 A1 Nov. 21, 2013

(30) Foreign Application Priority Data

Jan. 31, 2011 (JP) ..... 2011-017518

(51) Int. Cl.
*F23D 1/00* (2006.01)
*F23L 9/02* (2006.01)
(Continued)

(52) U.S. Cl.
CPC ..... *F23D 1/00* (2013.01); *F23C 1/10* (2013.01); *F23C 6/045* (2013.01); *F23C 9/08* (2013.01);
(Continued)

(58) Field of Classification Search
CPC ..... F23C 1/10; F23C 7/02; F23C 7/04; F23C 7/06; F23D 1/00; F23D 17/007; F23D 2201/00; F23D 2204/30
(Continued)

(56) References Cited

U.S. PATENT DOCUMENTS 4,135,874 A * 1/1979 Tsuzi ..... F23C 6/045 431/115
4,236,668 A * 12/1980 Prikkel, III ..... F23N 3/047 126/285 R
(Continued)

FOREIGN PATENT DOCUMENTS

DE 3048201 7/1982
JP U-49-122430 10/1974
(Continued)

OTHER PUBLICATIONS

International Search Report and Written Opinion dated Mar. 19, 2012 in corresponding PCT International Application No. PCT/JP2012/051774.
(Continued)

*Primary Examiner* — David J Laux
(74) *Attorney, Agent, or Firm* — Ostrolenk Faber LLP

(57) ABSTRACT

The burner device for high-temperature air combustion according to the present invention is equipped with a thermal insulation portion (5) that is provided facing a furnace (1) and has a throat (6); a burner nozzle (9) that is provided at the axial center of this throat and that injects a pulverized coal mixed flow (38) into the furnace through the throat; a windbox (8) that is provided so as to house this burner nozzle; an air register (16) that is provided at the distal end of the burner nozzle and that injects low-temperature secondary air from the windbox to the throat; a high-temperature air nozzle (23), one end of which opens into the furnace through the heat insulation portion; and a combustion air switching means (16, 24) that switches between injecting low-temperature secondary air to the throat through the air register and injecting high-temperature secondary air to the furnace interior through the high-temperature air nozzle, in which in steady combustion, low-temperature secondary air is injected to the throat through the air register by the
(Continued)

combustion air switching means and a pulverized coal mixed flow is injected from the burner nozzle, and in high-temperature air combustion, high-temperature secondary air is injected to the furnace interior through the high-temperature air nozzle by the combustion air switching means and a pulverized coal mixed flow is injected from the burner nozzle.

5 Claims, 2 Drawing Sheets

(51) Int. Cl.

| | |
|---|---|
| ***F23C 6/04*** | (2006.01) |
| ***F23C 9/08*** | (2006.01) |
| ***F23C 1/10*** | (2006.01) |
| ***F23D 17/00*** | (2006.01) |

(52) U.S. Cl.
CPC ..... *F23D 17/00* (2013.01); *F23L 9/02* (2013.01); *F23C 2202/30* (2013.01); *F23C 2900/06041* (2013.01)

(58) Field of Classification Search
USPC ..... 110/104 B
See application file for complete search history.

(56) References Cited

U.S. PATENT DOCUMENTS

| | | | | |
|---|---|---|---|---|
| 5,411,394 | A | 5/1995 | Beer et al. | 431/9 |
| 5,806,443 | A | 9/1998 | Kobayashi et al. | |
| 6,116,171 | A * | 9/2000 | Oota | F23C 6/045 110/263 |
| 2002/0197574 | A1 | 12/2002 | Jones et al. | |
| 2006/0115779 | A1 | 6/2006 | Yamamoto et al. | |
| 2009/0078175 | A1* | 3/2009 | Eiteneer | F23C 1/00 110/210 |
| 2010/0162930 | A1* | 7/2010 | Okazaki | F23C 7/008 110/190 |

FOREIGN PATENT DOCUMENTS

| | | |
|---|---|---|
| JP | 59-161605 | 9/1984 |
| JP | 08-028830 | 2/1996 |
| JP | 08-121712 | 5/1996 |
| JP | 09-310808 | 12/1997 |
| JP | A-10-089622 | 4/1998 |
| JP | 2001-124305 | 5/2001 |
| JP | 2001-208337 | 8/2001 |
| JP | 2002-5412 | 1/2002 |
| JP | A-2002-115818 | 4/2002 |
| JP | 2005-249348 | 9/2005 |
| JP | 2005-265298 | 9/2005 |
| JP | 2006-308249 | 11/2006 |
| JP | 2007-024335 | 2/2007 |
| JP | A-2008-309355 | 12/2008 |

OTHER PUBLICATIONS

Notice of Reasons for Rejection dated Jan. 17, 2014 in corresponding Japanese Patent Application No. 2012-555833.
Notice of Reasons for Rejection dated Jan. 21, 2014 in corresponding Japanese Patent Application No. 2012-555833.
Patent Examination Report dated Mar. 13, 2015 in corresponding Australian Patent Application No. 2012211903 (4 pages).

* cited by examiner

BURNER DEVICE FOR HIGH-TEMPERATURE AIR COMBUSTION

CROSS-REFERENCE TO RELATED APPLICATIONS

The present application is a 35 U.S.C. §§371 national phase conversion of PCT/JP2012/051774, filed Jan. 27, 2012, which claims priority to Japanese Patent Application No. 2011-017518, filed Jan. 31, 2011, the contents of which are incorporated herein by reference. The PCT International Application was published in the Japanese language.

TECHNICAL FIELD

The present invention relates to a burner device for high-temperature air combustion that causes high-temperature air combustion of pulverized fuel.

BACKGROUND ART

A burner device for high-temperature air combustion that causes the high-temperature air combustion of pulverized fuel, for example, pulverized coal, is provided in a pulverized coal-fired boiler. Patent Document 1 discloses a burner device in which a high-temperature air nozzle, a fuel nozzle, and a secondary air nozzle are individually arranged on the wall surface of a furnace in the vertical direction from the lower side. In this burner device, pulverized coal is injected from the fuel nozzle, high-temperature air is injected from the high-temperature air nozzle toward the pulverized coal flow, the pulverized coal ignites and combusts, and secondary air is injected from the secondary air nozzle above the flame, whereby the unburnt fuel combusts.

In the burner device that is shown in Patent Document 1, the three types of nozzles of the high-temperature air nozzle, the fuel nozzle, and the secondary air nozzle are provided, and high-temperature air combustion is realized by these three types of nozzles.

PRIOR ART DOCUMENTS

Patent Documents

[Patent Document 1] Japanese Unexamined Patent Application, First Publication No. 2005-265298

DISCLOSURE OF INVENTION

Problems to be Solved by the Invention

The present invention was achieved in view of this situation, and provides a burner device for high-temperature air combustion that enables high-temperature air combustion with a simpler nozzle constitution.

Means for Solving the Problems

The present invention provides a burner device for high-temperature air combustion comprises a thermal insulation portion that is provided facing a furnace and has a throat; a burner nozzle that is provided at the axial center of this throat and that injects a pulverized coal mixed flow into the furnace through the throat; a windbox that is provided so as to house this burner nozzle; an air register that is provided at the distal end of the burner nozzle and that injects low-temperature secondary air from the windbox to the throat; a high-temperature air nozzle, one end of which opens into the furnace through the heat insulation portion while the other end opens into the windbox; and a combustion air switching means that switches between injecting low-temperature secondary air to the throat through the air register and injecting high-temperature secondary air to the furnace interior through the high-temperature air nozzle, in which in steady combustion, low-temperature secondary air is injected to the throat through the air register by the combustion air switching means and a pulverized coal mixed flow is injected from the burner nozzle, and in high-temperature air combustion, high-temperature secondary air is injected to the furnace interior through the high-temperature air nozzle by the combustion air switching means and a pulverized coal mixed flow is injected from the burner nozzle.

Also, the burner device for high-temperature air combustion is further comprises a secondary air temperature adjusting means that extracts exhaust gas and mixes it with secondary air flowing into the windbox to adjust the temperature of the secondary air, in which in the state of the secondary air temperature adjusting means not mixing exhaust gas with the secondary air, the combustion air switching means closes the high-temperature air nozzle, and injects the secondary air via the air register, and in the state of the secondary air temperature adjusting means having mixed exhaust gas with the secondary air, the combustion air switching means closes the air register, and injects the secondary air via the high-temperature air nozzle.

Also, the present invention provides a burner device for high-temperature air combustion in which the low-temperature secondary air is air that is blown from a blower and heat exchanged with exhaust gas via a heat exchanger, and the high-temperature secondary air is air that is raised in temperature by exhaust gas being mixed with the low-temperature secondary air.

Also, the present invention provides a burner device for high-temperature air combustion in which during the transition from steady combustion to high-temperature air combustion, the combustion air switching means incrementally opens the high-temperature air nozzle, and incrementally closes the air register corresponding to the opening of this high-temperature air nozzle.

Also, the present invention provides a burner device for high-temperature air combustion in which the burner nozzle has a pulverized coal burner nozzle, and an oil burner nozzle that is provided inside of this pulverized coal burner nozzle to be concentric with the pulverized coal burner nozzle.

Effects of the Invention

The burner device for high-temperature air combustion of the present invention that has the aforementioned constitution exhibits the outstanding effects of being able to execute steady combustion and high-temperature air combustion by one burner device for high-temperature air combustion with a simple nozzle constitution, and a reduction in manufacturing costs being achieved.

BEST MODE FOR CARRYING OUT THE INVENTION

Hereinbelow, the embodiment of the present invention shall be described with reference to the drawings.

Figure 1:
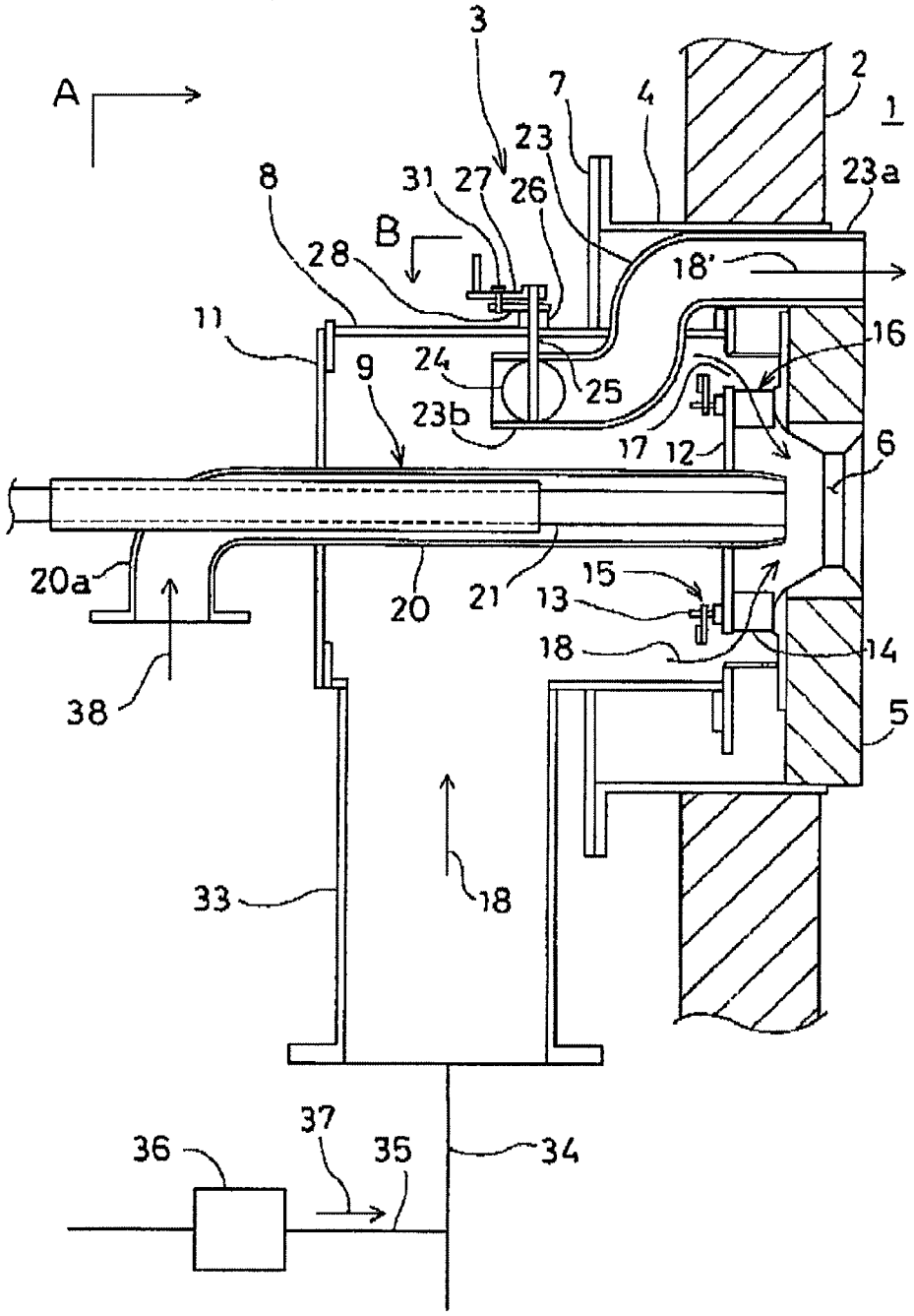
FIG. 1 is a cross-sectional view of the burner device for high-temperature air combustion according to one embodiment of the present invention.

FIG. 1 shows an example of the burner device for high-temperature air combustion according to the present embodiment. Hereinbelow, an outline of the burner device for high-temperature air combustion shall be described referring to FIG. 1.

In FIG. 1, 1 denotes a furnace, 2 denotes the furnace wall of the furnace 1, and in FIG. 1, the right side of the furnace wall 2 is the core.

A burner device for high-temperature air combustion 3 is provided on the furnace wall 2, and the burner device for high-temperature air combustion 3 is designed to form a flame toward the core. The burner device for high-temperature air combustion 3 is arranged at a predetermined interval in the horizontal direction or vertically in a plurality of levels. Also, the aspect of the arrangement is suitably determined by the scale of the furnace.

The burner device for high-temperature air combustion 3 shall be further described.

The burner device for high-temperature air combustion 3 has a burner housing 4. The burner housing 4 is cylindrically shaped with a horizontal axial center, and is provided penetrating the furnace wall 2. Also, the opening of the burner housing 4 on the core side (hereinbelow referred to as the distal end side) is blocked by a thermal insulation portion 5, and a throat 6 is provided at the center of the thermal insulation portion 5.

A flange base plate 7 is provided at the opening of the burner housing 4 on the side opposite the core (hereinbelow referred to as the base end side), and a cylindrical or an approximately cylindrical windbox 8 penetrates the center of the flange base plate 7, with the windbox 8 being provided in a concentric manner with the burner housing 4 via the flange base plate 7.

A burner nozzle 9 is provided on the center axis of the throat 6, and the burner nozzle 9 penetrates a base end plate 11 of the windbox 8, while the distal end thereof reaches the vicinity of the throat 6. The windbox 8 houses the burner nozzle 9, and forms a buffer space in which secondary air flows in around the burner nozzle 9.

A disc-shaped swirl vane support substrate 12 is provided at a position set back from the distal end of the burner nozzle 9 by a predetermined distance, swirl vane rotation shafts 13 are provided on the swirl vane support substrate 12 at a predetermined pitch on the same circumference, and a swirl vane 14 is fixed to each of the swirl vane rotation shafts 13. Also, the swirl vane rotation shafts 13, 13 are coupled by a link mechanism 15, and rotate in synchronization by the link mechanism 15. One of the swirl vane rotation shafts 13 is coupled to an actuator such as an air cylinder, and as a result of the swirl vane rotation shaft 13 being rotated by the actuator, all of the swirl vane rotation shafts 13 rotate in synchronization with respect to the swirl vane rotation shaft 13 that is coupled to the actuator. Also, due to the synchronous rotation of the swirl vane rotation shafts 13, the swirl vanes 14 rotate in synchronization.

The swirl vane rotation shaft 13, the swirl vane 14, the link mechanism 15 and the like constitute an air register 16, and the perimeter of the swirl vane support substrate 12 forms a secondary air inflow port 17, and secondary air 18 that flows into the air register 16 from the secondary air inflow port 17 can be swirled by the swirl vanes 14. Also, when the swirl vanes 14 are rotated to the maximum, the adjacent swirl vanes 14 overlap each other, and it is possible to completely close the secondary air inflow port 17.

The burner nozzle 9 is constituted from a pulverized coal burner nozzle 20 and an oil burner nozzle 21 that is provided on the center line of the pulverized coal burner nozzle 20, and the base end portion 20*a* of the pulverized coal burner nozzle 20 is bent to be separated from the oil burner nozzle 21, and connected to a pulverized coal mill that is not illustrated. Also, the oil burner nozzle 21 penetrates the base end portion 20*a*, and is connected to a fuel oil supply portion that is not illustrated.

Here, the pulverized coal burner nozzle 20 and the air register 16 constitute a pulverized coal burner, while the pulverized coal burner nozzle 20 and the oil burner nozzle 21 constitute an oil burner.

Also, a high-temperature air nozzle 23 that is bent in an S shape is provided between the windbox 8 and the burner housing 4. The distal end portion 23*a* of the high-temperature air nozzle 23 penetrates the thermal insulation portion 5 to open to the furnace 1, and the base end portion 23*b* of the high-temperature nozzle 23 opens to the interior of the windbox 8. The center axes of the distal end portion 23*a* and the base end portion 23*b* are respectively parallel with the center axis of the throat 6. Note that while the drawing illustrates the case of the distal end portion 23*a* being parallel with respect to the center axis of the throat 6, the distal end portion 23*a* may be inclined in the horizontal direction or in the vertical direction in order to obtain the optimal high-temperature air combustion.

A damper 24 is provided at the base end portion 23*b*, and a rotation shaft 25 of the damper 24 penetrates the windbox 8 to project to the outside. A bearing 26 is provided at the position where the rotation shaft 25 penetrates the windbox 8, and the rotation shaft 25 is supported in a freely rotatable manner in the windbox 8 via the bearing 26. An opening degree setting lever 27 is attached to the distal end of the rotation shaft 25.

An opening degree setting plate 28 is provided at the distal end of the bearing 26, and the outer surface of the opening degree setting plate 28 is parallel with the opening degree setting lever 27.

Figure 2A:
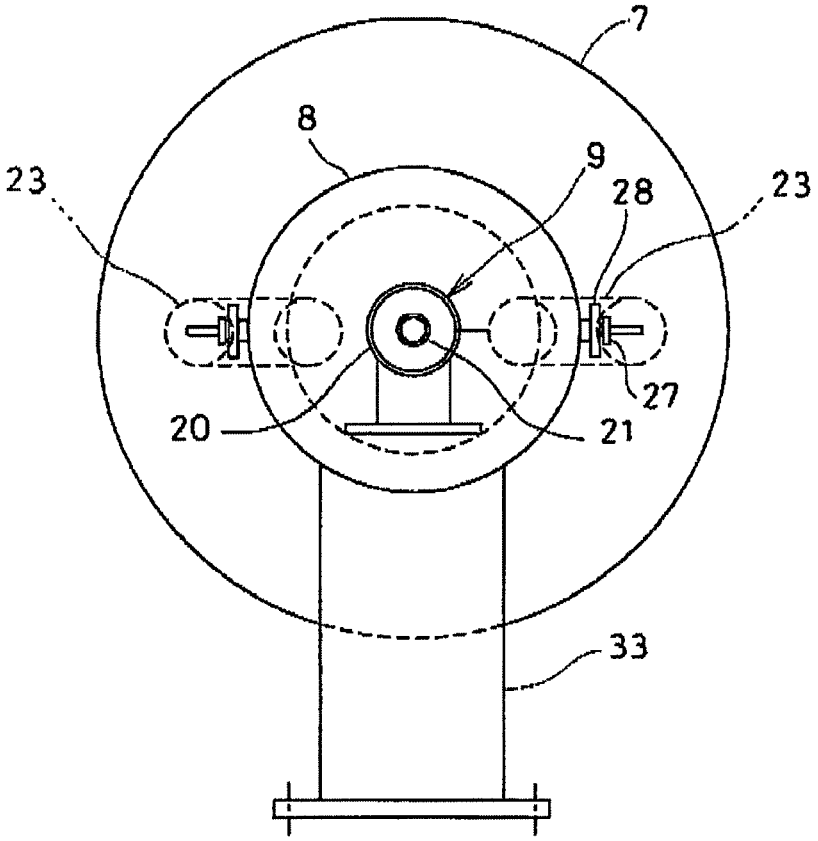
FIG. 2A is a partial side view of the burner device for high-temperature air combustion, along the arrow A of FIG. 1.
Figure 2B:
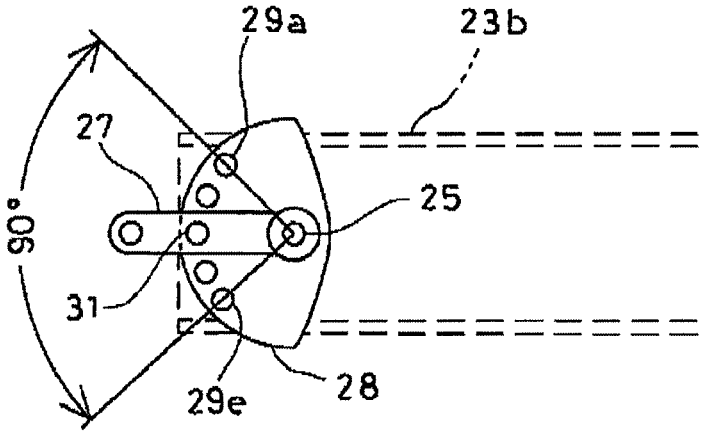
FIG. 2B is a partial side view of the burner device for high-temperature air combustion, along the arrow B of FIG. 1.

As shown in FIG. 2B, the opening degree setting plate 28 has a fan shape that is centered on the rotation shaft 25. Also, opening degree setting holes 29*a* to 29*e* are formed in the opening degree setting plate 28 at a predetermined angular pitch (22.5 degrees in the drawing) on the same periphery, and the angle formed by the opening degree setting holes 29*a* and 29*e* located at both ends is 90 degrees.

Also, an opening degree setting pin 31 is provided in the opening degree setting lever 27 in a detachable manner so as to face the outer surface of the opening degree setting plate 28, at a position of the same radius as the circumference at which the opening degree setting holes 29 are formed. The opening degree setting pin 31 is capable of being inserted in the opening degree setting hole 29, and by passing the opening degree setting pin 31 through the opening degree setting lever 27 and inserting it the opening degree setting hole 28, it is possible to fix the opening degree setting lever 27 at a predetermined angle. Also, since the opening degree setting lever 27 and the damper 24 integrally rotate via the rotation shaft 25, by inserting the opening degree setting pin 31 in any of the opening degree setting holes 29*a* to 29*e*, it is possible to fix the opening degree setting lever 27 at a predetermined angle, and it is possible to fix the damper 24 at a predetermined opening degree.

Note that in the state of the opening degree setting pin 31 inserted in the opening degree setting hole 29*a*, the damper 24 completely closes the base end portion 23*b*, and in the state of the opening degree setting pin 31 inserted in the opening degree setting hole 29*e*, the damper 24 is made to completely close the base end portion 23*b*, and so by making the opening degree setting pin 31 penetrate the opening degree setting lever 27, and selecting the opening degree setting hole 29*a* to 29*e* in which the opening degree setting pin 31 is to be inserted, it is possible to set in an incremental fashion the opening degree of the damper 24 from completely closed to completely open.

Note that in the state of FIG. 2B, the damper 24 is in the half-open state of a 45 degree rotation from the fully closed or fully open state.

Also, two pair of the high-temperature air nozzles 23 are provided at symmetrical positions in relation to the burner nozzle 9, as shown in FIG. 2A. In FIG. 2A, the two pair are provided in the horizontal direction. Note that in FIG. 1, so that the positional relationship of the burner nozzle 9 and the high-temperature air nozzles 23 becomes clear, only one pair is shown on the upper side, while the illustration of the other is omitted.

A secondary air duct 33 is in communication with the windbox 8, and the secondary air duct 33 is connected to a blower (not shown) via a secondary air supply line 34. An exhaust gas extraction line 35 is in communication with the secondary air supply line 34, the exhaust gas extraction line 35 is connected to a flue (not shown) of the boiler, and a flow regulating valve 36 is provided in the exhaust gas extraction line 35.

The exhaust gas extraction line 35 extracts high-temperature exhaust gas 37 from the flue. The extracted gas is merged with the secondary air 18 at the secondary air supply line 34, and the temperature of the secondary air 18 is raised. Also, the flow regulating valve 36 regulates the extraction amount of the exhaust gas, and the mixture ratio of the exhaust gas 37 and the secondary air is adjusted by the flow regulating valve 36. That is to say, the temperature of the secondary air 18 is adjusted by the flow regulating valve 36. Here, the exhaust gas extraction line 35 and the exhaust gas 37 constitute a secondary air temperature adjusting means for raising the temperature of the secondary air 18 by mixing high-temperature gas with the secondary air 18.

Note that the secondary air 18 itself undergoes heat exchange with the exhaust gas by a gas-air heat exchanger, whereby it is heated to 200° C.~350° C.

Also, in the aforementioned embodiment, the burner device for high-temperature air combustion 3 is unitized by using the burner housing 4 and the flange substrate 7, but it is also possible to provide the windbox 8 and the air register 16 in the furnace wall 2 without the burner housing 4 and the flange substrate 7. In this case, a portion of the furnace wall 2 functions as a thermal insulation portion 5.

Next, the action of the burner device for high-temperature air combustion 3 shall be described.

During the start of combustion and in the state of steady combustion of the burner device for high-temperature air combustion 3 (the state of fuel and oxygen being mixed and combusting), the damper 24 is in a state of having fully closed the high-temperature air nozzle 23.

Oil is supplied as fuel to the oil burner nozzle 21, and when the oil is injected toward the throat 6, it is ignited and auxiliary combustion is performed. The auxiliary combustion is continued until the interior of the furnace reaches a predetermined temperature, and when the interior of the furnace reaches the predetermined temperature, a pulverized coal mixed flow 38 is supplied to the pulverized coal burner nozzle 20, in the state of the secondary air 18 having reached a temperature sufficient for causing the pulverized coal to undergo self-sustaining combustion by heat exchange with the exhaust gas.

The pulverized coal mixed flow 38 flows while swirling around the oil burner nozzle 21, and is injected from the distal end of the pulverized coal burner nozzle 20. Also, the secondary air 18 is supplied through the secondary air duct 33 to the windbox 8, and the secondary air 18 is injected toward the throat 6 via the air register 16.

The secondary air 18 is swirled and undergoes flow regulation by the swirl vanes 14 in the process of passing through the air register 16. The pulverized coal mixed flow 38 that is injected from the pulverized coal burner nozzle 20 mixes with the secondary air 18, and the pulverized coal ignites and combusts (pulverized coal combustion).

The mixed combustion of auxiliary combustion and pulverized coal combustion is continued, and when the pulverized coal combustion by the pulverized coal mixed flow 38 reaches a state of self-sustaining combustion (steady combustion) being possible, the auxiliary combustion by the oil burner nozzle 21 is stopped, and it transitions to steady combustion by the pulverized coal burner only.

The temperature in the furnace rises due to the steady combustion, and when the temperature of the exhaust gas reaches the predetermined temperature of a high temperature, the flow regulating valve 36 opens by a predetermined opening degree, the exhaust gas 37 is extracted from the flue (not illustrated), mixed with the secondary air 18 that flows through the secondary air supply line 34 via the exhaust gas extraction line 35, and raises the temperature of the secondary air 18 to a predetermined value, that is, to a temperature that enables high-temperature air combustion, for example, 800° C.

Then, the exhaust gas 37 is mixed with the secondary air 18, and in the state of the secondary air 18 having reached a temperature at which high-temperature air combustion is possible, the damper 24 is fully opened, and moreover the air register 16 is fully closed. As a result, high-temperature air combustion of the pulverized coal is attained.

Note that in order to smoothly transition from the steady combustion to high-temperature air combustion, it is preferable to incrementally open the damper 24 corresponding to the temperature rising state of the secondary air 18, and incrementally close the air register 16 corresponding to the opening degree of the damper 24.

Here, the damper 24 and the air register 16 constitute a combustion air switching means that performs switching between the low-temperature secondary air for steady combustion and the high-temperature secondary air for high-temperature air combustion.

As a result of the air register 16 being fully closed, the supply of secondary air 18 to the throat 6 is stopped, and the pulverized coal mixed flow 38 that is injected from the pulverized coal burner nozzle 20 is injected into the furnace through the throat 6 without being mixed with the secondary air 18.

Also, the secondary air 18 that has reached a high temperature (hereinbelow referred to as high-temperature air 18') is injected from the high-temperature nozzle 23 that is arranged on both sides of the pulverized coal burner nozzle 20 toward the inside of the furnace parallel with the pulverized coal mixed flow 38. The pulverized coal mixed flow 38 gradually mixes with the high-temperature air 18', and slowly combusts under low oxygen and under a high temperature (high-temperature air combustion).

Accordingly, the combustion state of the pulverized coal is one of combustion in an environment in which there are no peaks in the combustion temperature and the oxygen density is low, and so it is possible to reduce the generation of nitrogen oxide (NOx).

Note that in the case of using pulverized coal with small amounts of volatile matter and pulverized coal that cannot achieve self-sustaining combustion, auxiliary combustion by an oil burner may be used in conjunction.

Also, in the case of transitioning from high-temperature air combustion to steady combustion, the reverse procedure to the case of transitioning from steady combustion to high-temperature air combustion is carried out.

As described above, in the case of transitioning from the start of combustion to steady combustion, and furthermore to high-temperature air combustion according to the present invention, combustion mode transition is possible by the burner device for high-temperature air combustion 3 of a single type according to the present invention. Also, the constitution of the burner device is simple, and since it is possible to simplify the equipment such as pipe arrangement associated with the burner, a reduction in equipment costs and a reduction in facility costs in the case of installing a burner are achieved.

Note that in the aforementioned embodiment, the opening/closing of the damper 24 may be performed by an actuator, the driving of the actuator, the air register 16, and the flow regulating valve 36 may be executed by a control device, and a thermal sensing device that detects the temperature of the exhaust gas in the flue or in the furnace may be provided, and based on the results of this temperature sensing device, the driving of the actuator, the air register 16, and the flow regulating valve 36 is controlled, so that the transition from the start of combustion to steady combustion, and from steady combustion to high-temperature air combustion may be performed automatically.

Also, the high-temperature air nozzle 23 was provided so as to inject high-temperature secondary air from the windbox 8 into the furnace, but a high-temperature secondary supply line may be separately provided, and the high-temperature secondary supply line may be connected to the high-temperature air nozzle 23 so as to supply the high-temperature secondary air directly to the high-temperature air nozzle 23 without passing through the windbox 8.

INDUSTRIAL APPLICABILITY

According to the burner device for high-temperature air combustion 3 of the present invention, it is possible to execute steady combustion and high-temperature air combustion with a simple nozzle constitution by a single burner device for high-temperature air combustion, and so a reduction in manufacturing cost is achieved.

DESCRIPTION OF THE REFERENCE SYMBOLS

1 furnace, 2 furnace wall, 3 burner device for high-temperature air combustion, 4 burner housing, 6 throat, 8 windbox, 9 burner nozzle, 15 link mechanism, 16 air register, 18 secondary air, 18' high-temperature air, 20 pulverized coal burner nozzle, 21, oil burner nozzle, 23 high-temperature air nozzle, 24 damper, 27 opening degree setting lever, 28 opening degree setting plate, 34 secondary air supply line, 35 exhaust gas extraction line, 36 flow regulating valve, 37 exhaust gas, 38 pulverized coal mixed flow

The invention claimed is:

1. A burner device for high-temperature air combustion, the burner device comprising:

a thermal insulation portion provided facing a furnace and comprising a throat;

a burner nozzle provided at the axial center of the throat and configured to inject a pulverized coal mixed flow into the furnace through the throat;

a windbox positioned and configured to house the burner nozzle;

an air register provided at a distal end of the burner nozzle so as to surround the burner nozzle and configured to inject secondary air for steady combustion from the windbox to the throat;

a high-temperature air nozzle having a non-concentric cylindrical shape when viewed from a furnace side, one end of the high-temperature air nozzle opens into the furnace through the thermal insulation portion while the other end of the high-temperature air nozzle opens into the windbox, and the high-temperature air nozzle is positioned and configured to inject secondary air for high-temperature air combustion having a higher temperature than that of the secondary air for steady combustion; and a combustion air switching member comprising the air register and a damper positioned at the high-temperature air nozzle, and the combustion air switching member configured to switch between injecting the secondary air for steady combustion to the throat through the air register and injecting the secondary air for high-temperature air combustion to the furnace interior through the high-temperature air nozzle, wherein in steady combustion, the secondary air for steady combustion is injected to the throat through the air register by the combustion air switching member and a pulverized coal mixed flow is injected from the burner nozzle, and in high-temperature air combustion, the secondary air for high-temperature air combustion is injected to the furnace interior through the high-temperature air nozzle by the combustion air switching member and a pulverized coal mixed flow is injected from the burner nozzle; and a secondary air temperature adjusting member comprising an exhaust gas extraction line and a flow regulating valve positioned in the exhaust gas extraction line, and the secondary air temperature adjusting member configured to extract exhaust gas and to mix the extracted exhaust gas with secondary air flowing into the windbox in order to raise the temperature of the secondary air, wherein in a first state of the secondary air temperature adjusting member, the secondary air temperature adjusting member does not mix exhaust gas with the secondary air, the combustion air switching member closes the high-temperature air nozzle, and injects the secondary air via the air register, in a second state of the secondary air temperature adjusting member, the secondary air temperature adjusting member having mixed exhaust gas with the secondary air, the combustion air switching member closes the air register, and injects the secondary air via the high-temperature air nozzle, and wherein the air register comprises a swirl vane configured to swirl the secondary air that flows into the air register, wherein the damper positioned at the high-temperature air nozzle is configured to rotate around a rotation shaft; and an opening degree setting lever attached to the rotation shaft is fixable at a predetermined angle to an opening degree setting plate having a fan shape that is centered on the rotation shaft, wherein during transition from the steady combustion to the high-temperature air combustion, the combustion air switching member incrementally opens the high-temperature air nozzle by selecting a fixing position of the opening degree setting lever to the opening degree setting plate, and incrementally closes the air register corresponding to the opening of the high-temperature air nozzle.

2. The burner device for high-temperature air combustion according to claim 1, wherein the secondary air for steady combustion is air that is blown from a blower and heat exchanged with exhaust gas via a heat exchanger, and the secondary air for high-temperature air combustion is air that is raised in temperature by exhaust gas being mixed with the secondary air for steady combustion.

3. The burner device for high-temperature air combustion according to claim 1, wherein the burner nozzle comprises:

a pulverized coal burner nozzle, and an oil burner nozzle positioned inside of this pulverized coal burner nozzle to be concentric with the pulverized coal burner nozzle.

4. The burner device for high-temperature air combustion according to claim 1, wherein the secondary air for high-temperature air combustion is injected from the high-temperature nozzle toward the furnace interior parallel with the pulverized coal mixed flow.

5. The burner device for high-temperature air combustion according to claim 1, wherein a pair of high-temperature air nozzles are positioned symmetrical about the burner nozzle.

* * * * *